US007243786B2

(12) United States Patent
Sollazzo

(10) Patent No.: US 7,243,786 B2
(45) Date of Patent: Jul. 17, 2007

(54) ERGONOMIC BEVERAGE SERVING TRAY

(76) Inventor: John Sollazzo, 11823 Lake Stone Way, Prospect, KY (US) 40059-9000

( * ) Notice: Subject to any disclaimer, the term of this patent is extended or adjusted under 35 U.S.C. 154(b) by 71 days.

(21) Appl. No.: 10/945,367

(22) Filed: Sep. 20, 2004

(65) Prior Publication Data

US 2006/0060477 A1 Mar. 23, 2006

(51) Int. Cl.
*B65D 75/00* (2006.01)
*A47G 19/00* (2006.01)
*A45F 5/00* (2006.01)

(52) U.S. Cl. ..... 206/201; 220/574; 294/143

(58) Field of Classification Search ..... 206/217, 206/557, 561–565, 201; 220/23.86, 556, 220/571; D7/574–575, 543–549, 552.1, D7/553.1, 553.2; 362/156; 294/3.5, 142–144
See application file for complete search history.

(56) References Cited

U.S. PATENT DOCUMENTS 2,207,017 A * 7/1940 Lemerman ..... 362/156
2,602,310 A * 7/1952 Hansen ..... 206/565
3,315,858 A * 4/1967 Horner ..... 220/574
3,955,672 A * 5/1976 Brundage ..... 206/562
4,341,304 A * 7/1982 Diller ..... 206/557
4,927,046 A * 5/1990 Armstrong ..... 220/697
5,769,264 A * 6/1998 Lipkowitz ..... 220/575
6,145,906 A * 11/2000 Wright et al. ..... 220/574
6,622,885 B1 * 9/2003 Erman ..... 220/571
6,923,485 B1 * 8/2005 Bauswell ..... 294/3.5

* cited by examiner

*Primary Examiner*—Bryon P. Gehman
(74) *Attorney, Agent, or Firm*—Armstrong Teasdale LLP

(57) ABSTRACT

A tray for serving beverages includes a first beverage support section, a second beverage support section, and a contoured arm rest member extending from the first beverage support section and the second beverage support section. The tray also includes at least one branch member extending from the first beverage support section and the second beverage support section. The tray further includes a base extending from the contoured arm rest member and the branch member. A handle extends from the base.

20 Claims, 3 Drawing Sheets

ERGONOMIC BEVERAGE SERVING TRAY

BACKGROUND OF THE INVENTION

This invention relates generally to trays, and, more particularly, to trays for carrying beverages in containers such as glasses, cups, bottles, or cans.

In a crowded room it can be difficult for a server to navigate through the crowd or open a door while holding a plurality of beverages in both hands. Servers often hold and balance the beverages in one hand to leave the other free to avoid the obstacles encountered during transporting the beverages. Unfortunately, this can lead to accidents such as spills, clothing damage, slippery floors, and revenue loss.

Another area of difficulty for a server carrying beverages is in recording a customer's order. The server must either go to a server station to set down the drinks and return with a pad and a pencil, or set the tray down on a nearby table. Making multiple trips would waste the server and the customer's time, and setting the tray down on another customer's table would be unacceptable. Ideally, the server could take the customer's order while safely and securely carrying the beverages.

BRIEF SUMMARY OF THE INVENTION

In one aspect, a tray for serving beverages is provided that includes a first beverage support section, a second beverage support section, and a contoured arm rest extending from the first beverage support section and the second beverage support section. The tray also includes at least one branch member extending from the first beverage support section and the second beverage support section. The tray further includes a base extending from the contoured arm rest member and the branch member. A handle extends from the base.

In another aspect, a method of fabricating a tray for serving beverages is provided. The method includes forming a base, a handle, a contoured arm rest member, at least one branch member, and at least one beverage support section in a one piece construction.

In yet another aspect, a method of assembling a tray for serving beverages is provided. The method includes connecting a first beverage support section and a second beverage support section to a contoured arm rest member and connecting at least one branch member to the first and second sections. The method further includes connecting a base to the contoured arm rest member and to the branch member and connecting a handle to the base.

DETAILED DESCRIPTION OF THE INVENTION

Figure 1:
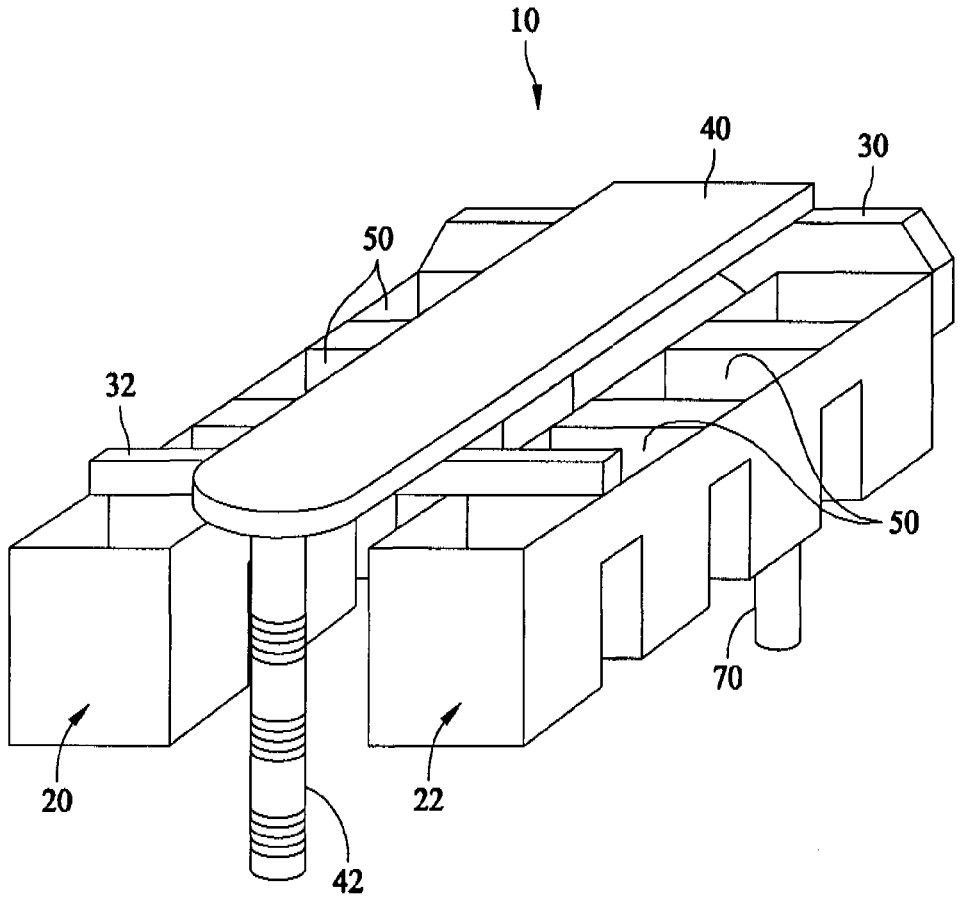
FIG. 1 is an embodiment of a tray for serving beverages.
Figure 2:
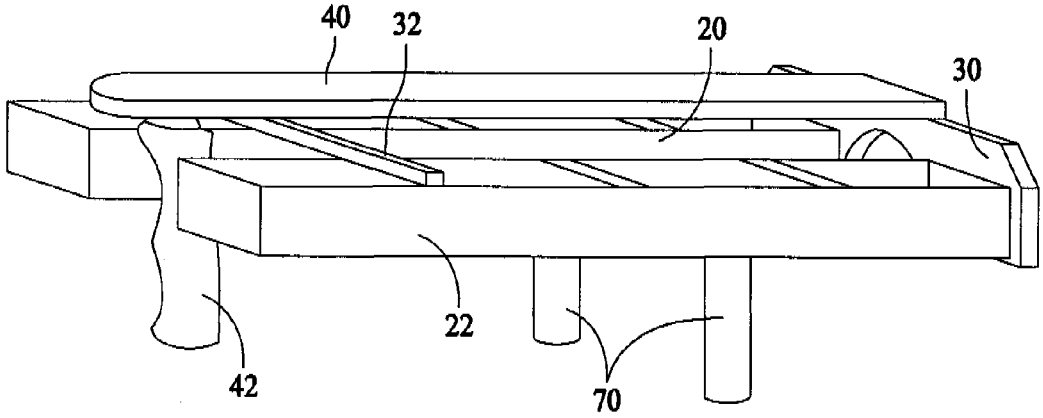
FIG. 2 is a side view of the tray shown in FIG. 1.

FIGS. 1 and 2 illustrate an embodiment of a tray 10 for serving beverages. Tray 10 includes a first beverage support section 20, a second beverage support section 22, a contoured arm rest member 30, at least one branch member 32, a base 40, and a handle 42. In one embodiment, tray 10 is formed as a unitary tray and is either vacuum formed or injection molded. In another embodiment, tray 10 is configured to be stackable to facilitate ease of storage.

Beverage support sections 20 and 22 are substantially rectangular shaped. In a further embodiment, beverage support sections 20 and 22 are substantially semi-circle shaped. Beverage support sections 20 and 22 each include a plurality of subsections 50 configured to securely hold a beverage container, such as a glass, cup or can. In one embodiment, subsections 50 have a substantially square cross section, although alternative embodiments have differently shaped cross sections, and each subsection 50 includes a bottom (not shown). In a further embodiment, one or more of subsections 50 do not include a bottom.

First beverage support section 20 and second beverage support section 22 extend from contoured arm rest member 30. Branch member 32 extends from and substantially spans the distance between first beverage support section 20 and second beverage support section 22. In one embodiment, branch member 32 is a contoured arm rest member. In another embodiment, tray 10 includes a plurality of branch members 32 extending and substantially spanning the distance between first beverage support section 20 and second beverage support section 22.

Base 40 extends from contoured arm rest member 30 and branch member 32 and forms a shelf or table on top of contoured arm rest member 30 and branch member 32. Handle 42 is substantially solid and extends from base 40 integral to a vacuum formed or injection molded tray 10. In an alternative embodiment, handle 42 is attached by a screw to the underside of base 40. In a further embodiment, handle 42 is attached to base 40 by one of an adhesive, a nut and bolt, and a friction fit. In another embodiment, handle 40 is pivotally attached to base 40 and is able to lock in a position substantially vertical, while tray 10 is in use, and in a position substantially horizontal to base 40, for storing tray 10. In one embodiment, handle 42 has a substantially pistol grip style.

In one embodiment, subsections 50 are substantially cylindrically shaped and do not include a bottom. In another embodiment, subsections 50 are tapered to allow a portion of a beverage container to be suspended by and extended partially through subsection 50. The beverage container is supported by the container in the tapered portion or by a lip or catch point of the container. In an alternative embodiment, subsections 50 are baskets or nets suspended or extending from beverage support sections 20 and 22. In another alternative embodiment, beverage support sections 20 and 22 include subsections 50 of different sizes, to hold different sized glasses, and/or different types, such as baskets, nets, and beverage holders. In yet another alternative embodiment, subsections 50 are modularly interchangeable.

In a further embodiment, contoured arm rest 30 includes a pad or covering attached to the arm contoured section of contoured arm rest 30 for a more comfortable feel while tray 10 is in use. In another alternative embodiment, contoured arm rest 30 includes a strap attached to tray 10 to assist in holding contoured arm rest 30 to a user's arm.

A plurality of tray support legs 70 extend from first and second beverage support sections 20 and 22. In one embodiment, two support legs 70 (one visible in FIG. 1) and handle 42, utilized as a third leg, together form a tripod configured to facilitate supporting tray 10 on a surface such as a table or bar. In another embodiment, tray 10 includes four support legs 70 and handle 42 is sized shorter than support legs 70. Legs 70 are integral to a vacuum formed or injection molded tray 10.

Figure 3:
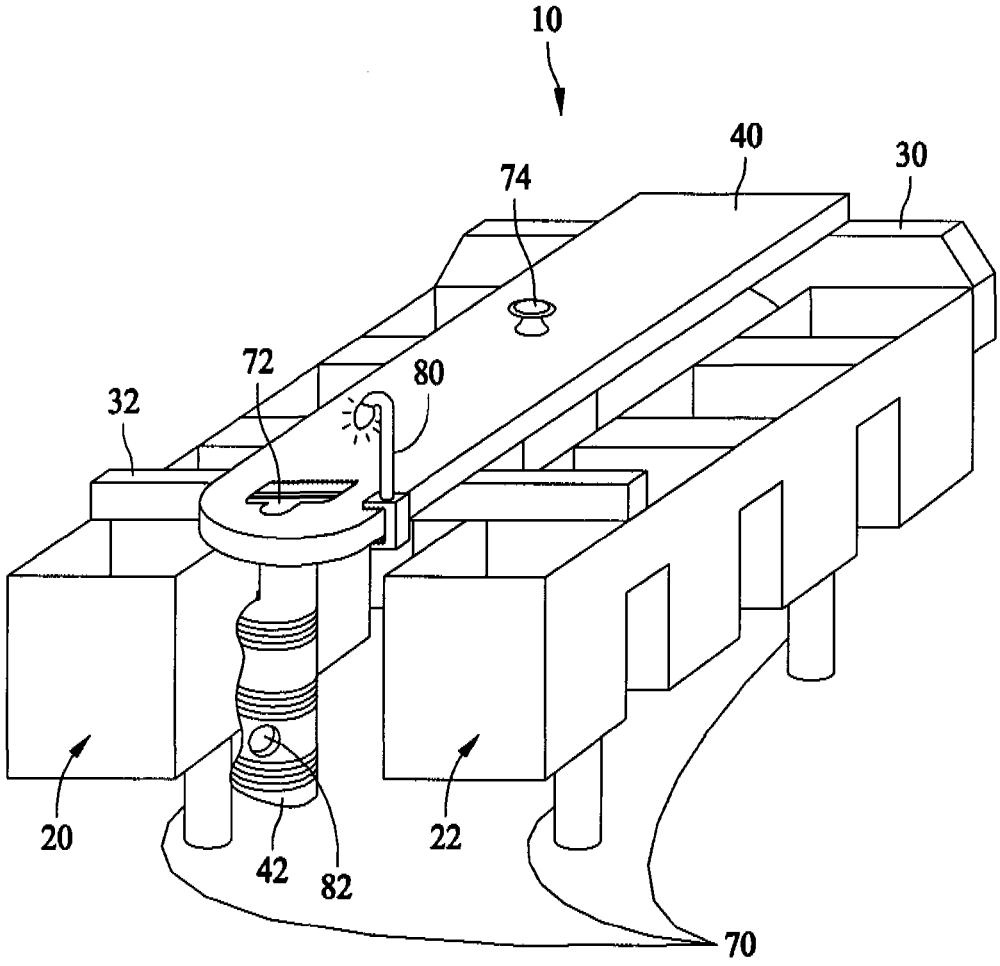
FIG. 3 is an embodiment of the tray including accessories.

FIG. 3 is an embodiment of tray 10 including accessories such as a clamp or clip 72 attached to base 40. Clip 72 is positioned on base 40 to hold items such as a pad for taking orders, a bill, a check, a credit card, cash, or a receipt. In one embodiment, a knob 74 is attached to base 40. Knob 74 adds another element of stabilization to tray 10 while transporting beverages. In a further embodiment, an illumination device 80 for lighting tray 10 is attached to tray 10. Illumination device 80 is controlled, such as turning on and turning off, by an actuator 82 attached to tray 10 at handle 42.

Tray 10 facilitates safely and securely supporting a plurality of beverages transported in a crowded room with one arm, leaving the other arm free to record orders, write bills, or open a door. In one embodiment, tray 10 components are coupled together with screws. In an alternative embodiment, tray 10 components are coupled together with adhesive or staples. Alternatively, any method to facilitate coupling tray 10 components may be used to form tray 10. In another alternative embodiment, an advertisement is attached to tray 10.

While the invention has been described in terms of various specific embodiments, those skilled in the art will recognize that the invention can be practiced with modification within the spirit and scope of the claims.

What is claimed is:

1. A tray for serving beverages comprising:

a first beverage support section comprising a first plurality of beverage baskets;

a second beverage support section comprising a second plurality of beverage baskets;

a contoured arm rest member extending from said first beverage support section and said second beverage support section, such that said first plurality of beverage baskets extend from a first end portion of said contoured arm rest and said second plurality of beverage baskets extend from a second end portion of said contoured arm rest;

at least one branch member extending from said first beverage support section to said second beverage support section;

a base extending from said contoured arm rest member and said at least one branch member; and a handle extending from said base.

2. A tray according to claim 1 further comprising a plurality of tray support legs, said tray support legs extending from at least one of said base and said first beverage support section and said second beverage support section.

3. A tray according to claim 1 wherein said first beverage support section, said second beverage support section, said contoured arm rest member, said branch member, said base, said handle, and a plurality of tray support legs are unitary.

4. A tray according to claim 1 wherein said handle comprises a pistol grip handle.

5. A tray according to claim 1 further comprising a clip attached to said base.

6. A tray according to claim 1 further comprising a knob attached to said base.

7. A tray according to claim 1 wherein said tray is stackable.

8. A tray according to claim 1 further comprising an illumination device for lighting the tray.

9. A tray according to claim 8 further comprising an actuator attached to said handle for controlling energization of said illumination device.

10. A tray according to claim 1 wherein said branch member is a contoured arm rest member.

11. A method for assembling a tray for serving beverages, said method comprising:

coupling a base, a handle, a contoured arm rest member, at least one branch member, and at least one beverage support section to form an integral construction; and extending the contoured arm rest member between a first beverage support section having a first plurality of beverage baskets and a second beverage support section having a second plurality of beverage baskets, such that the first plurality of beverage baskets extend from a first end portion of the contoured arm rest and the second plurality of beverage baskets extend from a second end portion of the contoured arm rest.

12. A method according to claim 11 further comprising integrally coupling a plurality of tray support legs in the an integral construction.

13. A method according to claim 11 further comprising connecting a clip to the base.

14. A method according to claim 11 further comprising forming the integral construction being stackable.

15. A method of assembling a tray for serving beverages, said method comprising:

connecting a first beverage support section and a second beverage support section to a contoured arm rest member, wherein the first beverage support section includes a first plurality of beverage baskets that extend from a first end portion of the contoured arm rest member, and the second beverage support section includes a second plurality of beverage baskets that extend from a second end portion of the contoured arm rest;

connecting at least one branch member to the first and second sections;

connecting a base to the contoured arm rest member and at least one branch member; and connecting a handle to the base.

16. A method according to claim 15 further comprising connecting a plurality of tray support legs to at least one of the base, the first beverage support section and the second beverage support section.

17. A method according to claim 15 further comprising connecting a clip to the base.

18. A method according to claim 15 further comprising connecting a knob to the base.

19. A method according to claim 15 further comprising connecting an illumination device to the tray.

20. A method according to claim 15 wherein the branch member is a contoured arm rest member.

* * * * *